US007775768B2

(12) United States Patent
Devore et al.

(10) Patent No.: US 7,775,768 B2
(45) Date of Patent: Aug. 17, 2010

(54) TURBINE COMPONENT WITH AXIALLY SPACED RADIALLY FLOWING MICROCIRCUIT COOLING CHANNELS

(75) Inventors: Matthew A. Devore, Manchester, CT (US); Blake J. Luczak, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 615 days.

(21) Appl. No.: 11/682,342

(22) Filed: Mar. 6, 2007

(65) Prior Publication Data

US 2008/0219854 A1 Sep. 11, 2008

(51) Int. Cl.
*F01D 5/18* (2006.01)

(52) U.S. Cl. ..... 416/97 R

(58) Field of Classification Search ..... 416/97 R
See application file for complete search history.

(56) References Cited

U.S. PATENT DOCUMENTS 4,434,835 A * 3/1984 Willgoose ..... 164/34
5,356,265 A 10/1994 Kercher
5,931,638 A 8/1999 Krause
6,280,140 B1 * 8/2001 Soechting et al. ..... 416/97 R
6,331,217 B1 12/2001 Burke
6,402,470 B1 6/2002 Kvasnak
6,514,042 B2 2/2003 Kvasnak
6,890,154 B2 5/2005 Cunha
6,896,487 B2 5/2005 Cunha
7,097,425 B2 8/2006 Cunha
2001/0016162 A1 * 8/2001 Lutum et al. ..... 416/97 R
2002/0021966 A1 2/2002 Kvasnak
2006/0039787 A1 * 2/2006 Goodman et al. ..... 416/97 R
2006/0096092 A1 * 5/2006 Pietraszkiewicz et al. ..... 29/889.72

* cited by examiner

*Primary Examiner*—Richard Edgar
(74) *Attorney, Agent, or Firm*—Carlson, Gaskey & Olds PC

(57) ABSTRACT

An airfoil for a gas turbine engine component such as a turbine blade or a vane includes at least one microcircuit cooling channel having a plurality of sub-channels extending along a radial direction of the airfoil. The plurality of channels are axially spaced, and are fed by radially spaced inlets.

18 Claims, 4 Drawing Sheets

TURBINE COMPONENT WITH AXIALLY SPACED RADIALLY FLOWING MICROCIRCUIT COOLING CHANNELS

BACKGROUND OF THE INVENTION

This application relates to a turbine component, such as a turbine blade or vane, wherein microcircuit cooling channels include a plurality of axially spaced radially extending channels, wherein the channels are fed by a plurality of radially spaced inlets.

Gas turbine engines are known, and typically include a plurality of sections mounted in series. Typically, a fan delivers air to compressor sections. The air is compressed and delivered downstream into a combustor section. Air is mixed with fuel in the combustor section and burned. Hot products of combustion are delivered downstream over turbine rotors, and cause the turbine rotors to rotate.

Typically, the turbine rotors include a plurality of removable blades, and a plurality of static vane sections positioned intermediate successive turbine stages. The products of combustion are quite hot, and thus the turbine blades and vanes are subjected to very high temperatures. To protect these components from the detrimental effect of the high temperatures gases, various schemes are provided for cooling the components. One cooling scheme is to circulate cooling air within an airfoil associated with the component. A plurality of relatively large central cooling channels may circulate air within a body of the airfoil. More recently, heat exchangers have been formed as local cooling channels between the central cooling channels and an outer wall at relatively hot locations on the airfoil. These so-called "microcircuit" cooling channels included a plurality of sub-channels spaced radially relative to a rotational axis of the turbine rotors. Air passing through these sub-channels generally flows along a direction parallel to the axis of rotation. The radially spaced sub-channels are supplied cooling air from a plurality of radially spaced inlets which connect into one of the central cooling channels.

Radially extending cooling channels provide beneficial cooling effects in some applications. However, to provide radially extending, axially spaced cooling sub-channels would require a plurality of axially spaced inlets. This could create a relatively large void parallel to the axis of the rotation, creating a structural weak point on the airfoil, which would be undesirable since the blades rotate at very high speeds.

SUMMARY OF THE INVENTION

In a disclosed embodiment, a gas turbine engine component having an airfoil is provided with at least one microcircuit cooling channel, wherein the microcircuit cooling channel includes a plurality of individual sub-channels which are spaced along an axial direction defined by an axis of rotation of a turbine rotor. Cooling air is delivered into these sub-channels, and the sub-channels extend generally radially to provide cooling to a select area of the airfoil. The plurality of sub-channels are supplied with cooling air by a plurality of radially spaced inlets. Thus, the void or space provided by the bank of inlets extends along a radial direction of the airfoil, and is not as detrimental to the structural integrity of the airfoil as would be the case if the inlets were spaced axially.

These and other features of the present invention can be best understood from the following specification and drawings, the following of which is a brief description.

DETAILED DESCRIPTION OF THE PREFERRED EMBODIMENT

Figure 1:
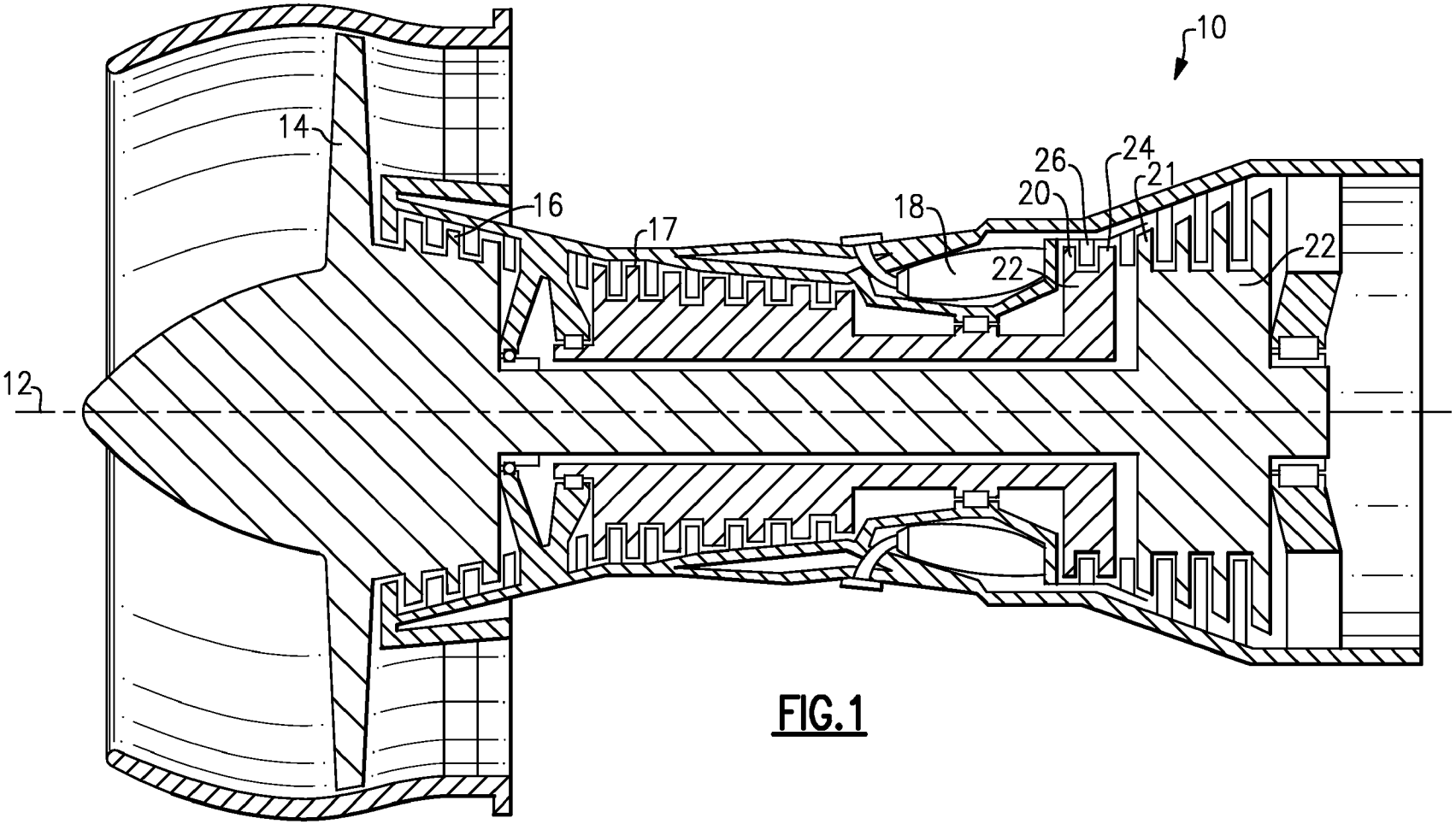
FIG. 1 is a simplified cross-sectional view of a standard gas turbine engine.

A gas turbine engine 10, such as a turbofan gas turbine engine, circumferentially disposed about an engine centerline, or axial centerline axis 12 is shown in FIG. 1. The engine 10 includes a fan 14, compressors 16 and 17, a combustion section 18 and turbines 20 and 21. This application extends to engines without a fan, and with more or fewer sections. As is well known in the art, air compressed in the compressors 16 and 17, mixed with fuel and burned in the combustion section 18 and expanded in turbines 20 and 21. The turbines 20 and 21 include rotors 22 which rotate in response to the expansion, driving the compressors 16 and 17, and fan 14. The turbines comprise alternating rows of rotating airfoils or blades 24 and static airfoils or vanes 26. In fact, this view is quite schematic, and blades 24 and vanes 26 are actually removable from the rotors 22. It should be understood that this view is included simply to provide a basic understanding of the sections in a gas turbine engine, and not to limit the invention. This invention extends to all types of gas turbine engines for all types of applications.

Figure 2:
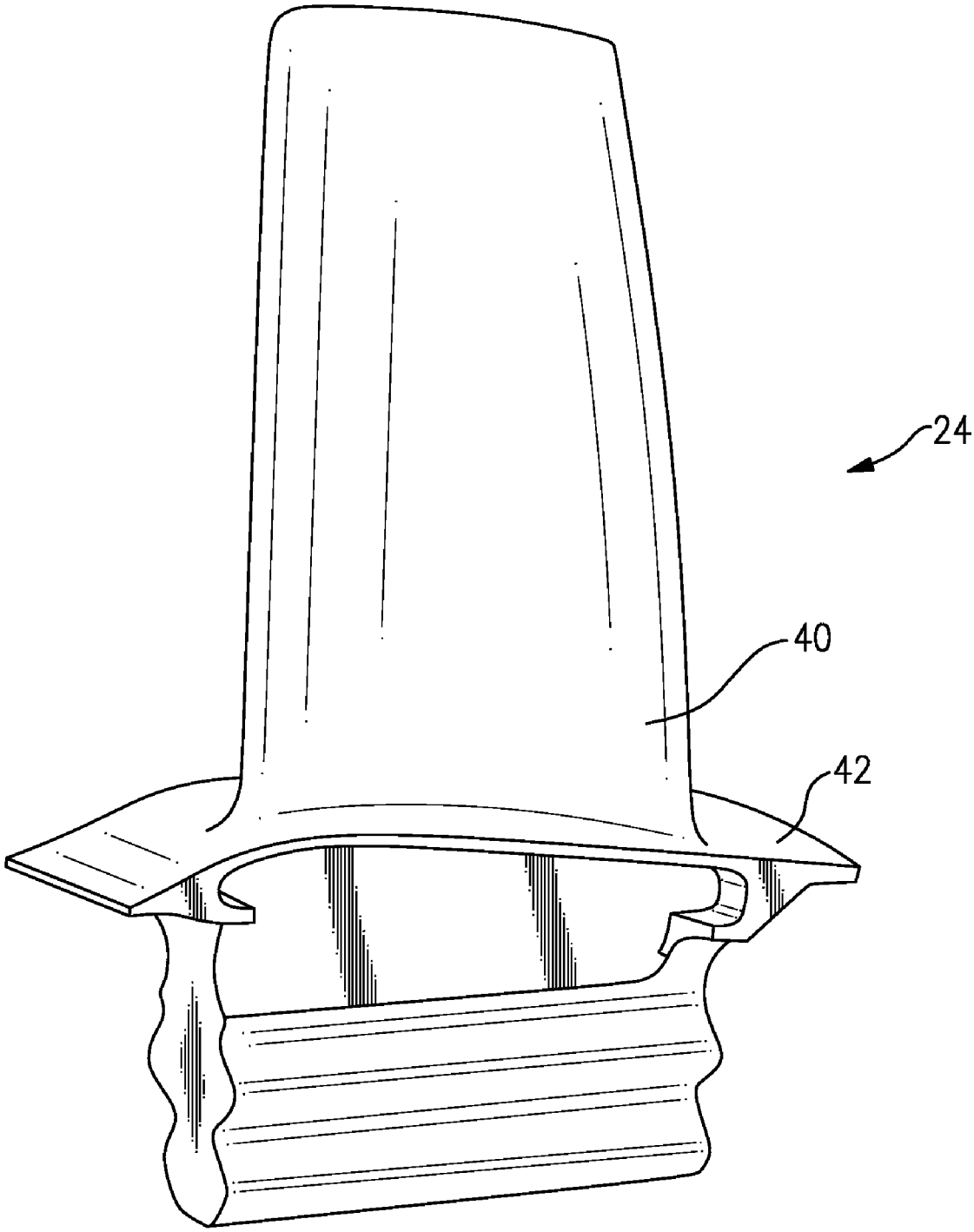
FIG.2 Prior Art
FIG. 2 shows a turbine blade as is generally known in the prior art.

FIG. 2 shows a turbine blade 24 as known. As known, a platform 42 is provided at a radially inner portion of the blade 24, while an airfoil 40 extends radially (as seen from the centerline 12) outwardly from the platform 42. As mentioned above, it is typical to provide cooling air within the airfoil 40.

Figure 3:
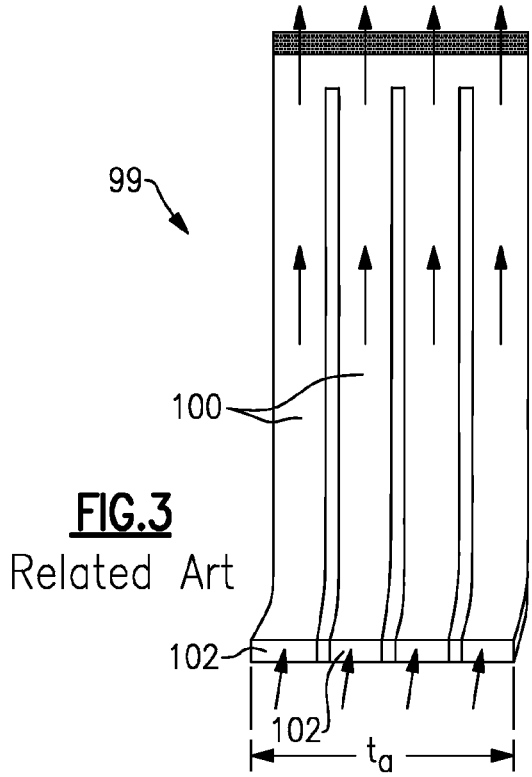
FIG.3 Related Art
FIG. 3 shows a cooling channel incorporated into an airfoil.

FIG. 3 shows a microcircuit cooling channel 99 as has been proposed by others that work in the same company as the inventor, and who would be under a duty to assign to the assignee of this application. As shown in FIG. 3, a microcircuit cooling channel includes a plurality of axially spaced sub-channels 100 which deliver cooling air along a radial direction of an airfoil. This cooling channel 99 includes a plurality of inlets 102 which communicate with a central cooling channel. As can be appreciated from this figure, the inlets 102 would be spaced parallel to the axis of rotation 12. Thus, a relatively long void along the axis of rotation is provided by these aligned inlets 102, and could harm the structural integrity of the airfoil.

Figure 4A:
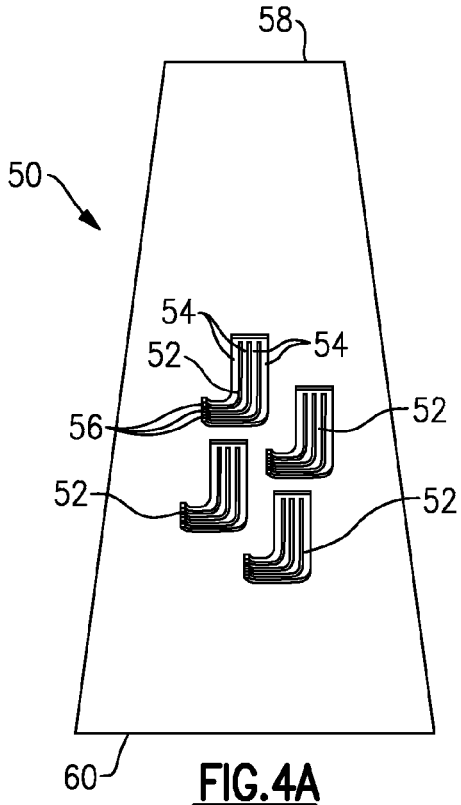
FIG. 4A shows a first schematic view of the present invention.

FIG. 4A shows an embodiment of the present invention incorporated into a turbine blade 50. As shown, a plurality of microcircuit cooling channels 52 each include a plurality of axially spaced sub-channels 54 which generally extend radially, and from a base section 60 of the airfoil of the turbine blade 50, towards a tip 58. Microcircuit cooling channels 54 are located at local hot spots on the airfoil. A plurality of inlets 56 are spaced radially, and include turns to direct the cooling air, and deliver that cooling air to the sub-channels 54. As will be appreciated, with this invention, the void provided by the bank of inlets extends generally along the radial axis of the airfoil, and is less detrimental to the structural integrity.

Figure 4B:
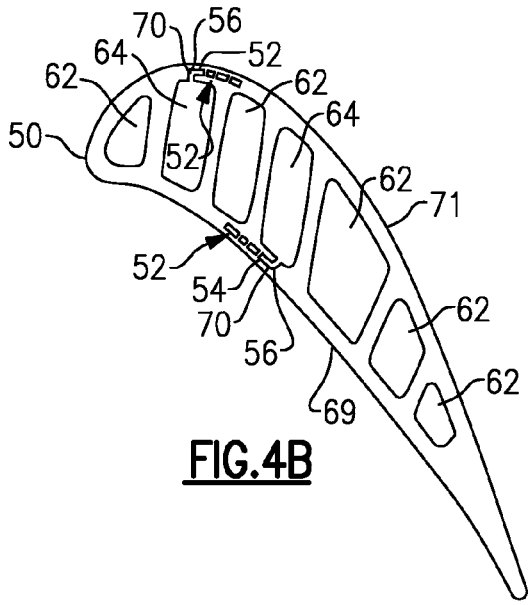
FIG. 4B is a cross-sectional view of a gas turbine component incorporating the present invention.

As shown in FIG. 4B, a plurality of central cooling channels 62 extend radially through the airfoil of the turbine blade 50, as is known. Cooling channels 64 communicate with the inlets 56 and provide cooling air to microcircuit cooling channels 52. As known, a microcircuit cooling channel is extremely thin, and relatively small. The size of the microcircuit cooling channels as shown in FIGS. 4A and 4B may be somewhat exaggerated such that one can appreciate the details. As can be appreciated in FIGS. 4A and 4B, the microcircuit cooling sub-channels 54 extend in a direction having a majority of a component of its direction in the radial direction. However, the inlets 56 extend along a direction having a major component of its direction parallel to the axis of rotation 12.

Figure 4C:
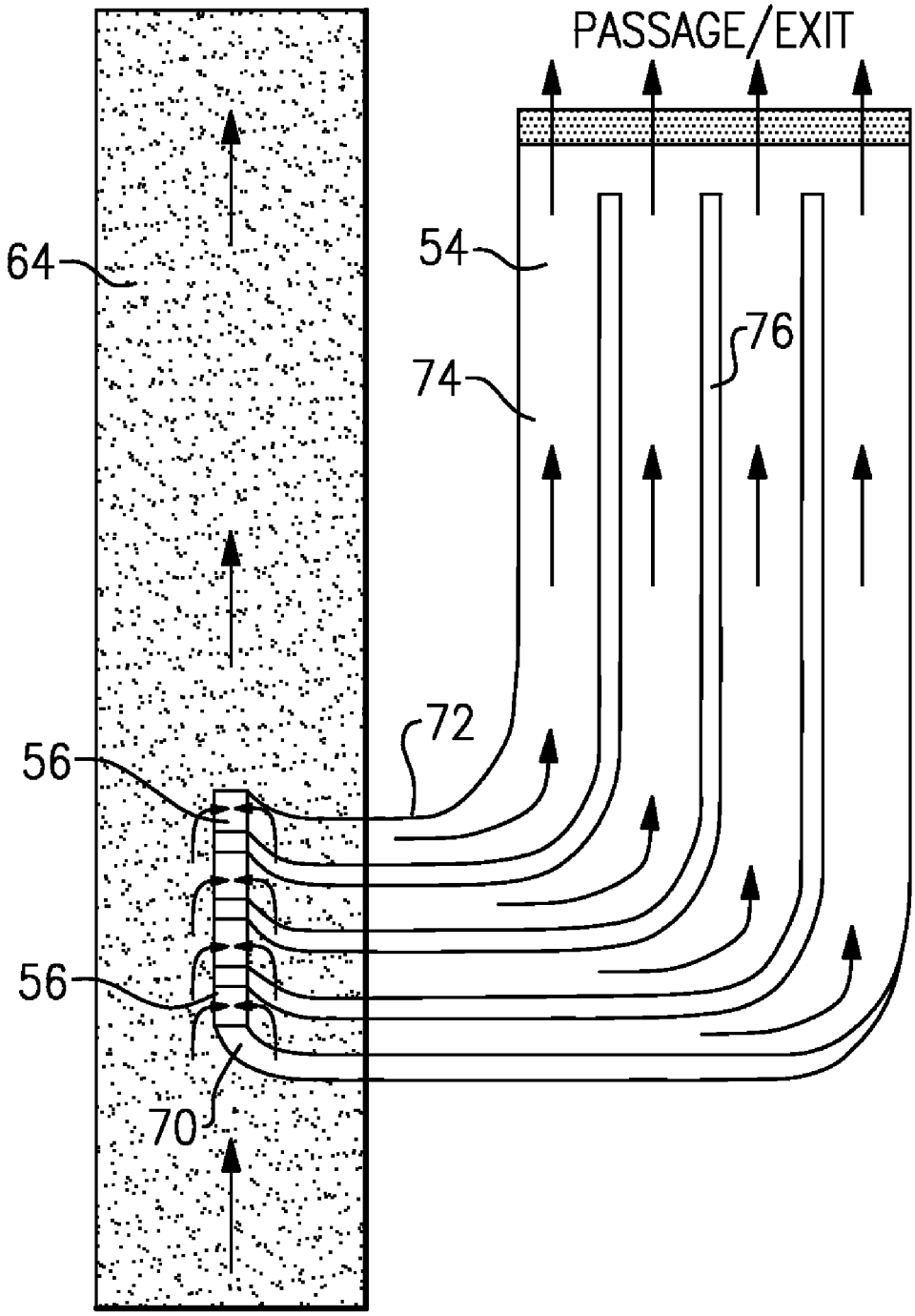
FIG. 4C schematically shows the flow directions of cooling air in the disclosed cooling channels.

Thus, can be further appreciated from FIG. 4C, the void created by the spaced inlets 56 extends along the radial axis of the airfoil, and is thus less detrimental to the structural integrity of the airfoil. As can be seen, the inlet merges into a first portion 70 extending toward a wall 69 or 71 (FIG. 4B) of the airfoil, and then to an axially extending portion 72. As can be appreciated, wall 71 is convex, and wall 69 is concave. From axially extending portion 72, the sub-channels quickly bends into the sub-channels 54. Intermediate walls 76 define the sub-channels 54 and are a structural part of the airfoil. The air may exit through the walls 69 or 71, from the end of the sub-channels and through skin cooling slots or holes.

The microcircuit sub-channel voids are formed by a rigid, removable core during the blade investment casting process. The castings are made from cobalt or nickel based aerospace alloys for strength and oxidation resistance. The microcircuit cores are typically made from ceramic or refractory materials and are individually attached to ceramic central cores. After the blade casting is formed, the microcircuit cores are removed by leached with caustic materials and/or oxidation with high temperatures. The removable core would look much like the arrangement shown in FIG. 4C, with a core portion for forming the channel 64, and another core portion for forming the microchannels. The core would be the mirror image of the FIG. 4C arrangement, with the portions that are solid in FIG. 4C being voids in the core (such as voids to form the walls 76), and the portions which are hollow in the FIG. 4C arrangement, being solid in the core.

The microcircuit cooling channels as shown in this application are simplified. In practice, various heat exchanger enhancement structures such as trip strips, pedestals, etc., may be incorporated into the cooling channels to enhance convective cooling.

In addition, various structural enhancement features and/or various cooling flow management features can be added. As an example, at certain radial locations, the walls 76 could be segmented to allow flow communication between the several channels. Also, at certain radial locations, one or more of the walls could be eliminated to vary the number of channels. A worker of ordinary skill in this art would recognize the various challenges that could point to any of these modifications.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A gas turbine engine component comprising:

a platform and an airfoil extending radially from the platform relative to an axis of rotation of a turbine that will receive the component;

at least one central cooling channel extending in said airfoil, said airfoil having a thickness measured between a concave wall and a convex wall, with said at least one central cooling channel being formed between said concave and said convex walls, and a plurality of inlets radially spaced along the airfoil each inlet sharing an intermediate wall, said plurality of inlets each for communicating cooling air from said at least one central cooling channel to a radially extending plurality of sub-channels each subchannel sharing an intermediate wall extending along a direction having a major component in a radial direction of the airfoil, said radially extending sub-channels being axially spaced.

2. The gas turbine engine component as set forth in claim 1, wherein said radially extending sub-channels providing a microcircuit having a relatively thin thickness in a direction defined between said central cooling channel and one of said concave and convex walls of the airfoil.

3. The gas turbine engine component as set forth in claim 2, wherein there are a plurality of microcircuit cooling channels in said airfoil.

4. The gas turbine engine component as set forth in claim 2, wherein air passes into said inlets, and toward said one wall, said inlets communicating with a first 90° bend into a plurality of communication channels, said first 90° bend extending into a direction generally parallel with said outer wall, and into a second 90° bend, said second 90° bend turning said plurality of communication channels into said radially extending sub-channels, and radially through the airfoil.

5. The gas turbine engine component as set forth in claim 1, wherein said gas turbine engine component is a turbine blade.

6. The gas turbine engine component of claim 1 wherein said component is placed within said air foil to cool selected hot spots in said airfoil.

7. The gas turbine engine component of claim 1 wherein said subchannel and said inlet are extremely thin and small relative to said airfoil.

8. A gas turbine engine comprising:

a compressor section;

a combustor section;

a turbine section for rotation about a central axis, said turbine section including at least one rotor having a plurality of rotor blades, and a plurality of static vanes positioned adjacent said rotor blades, each of said rotor blades and said static vanes having an airfoil portion, and the airfoil portion of at least one of said rotor blades and said vanes including at least one central cooling channel extending in said airfoil, said airfoil having a thickness measured between a concave wall and a convex wall, with said at least one central cooling channel being formed between said concave and said convex walls, and there being a plurality of plurality of inlets spaced along a radial axis of the airfoil each inlet sharing an intermediate wall, said plurality of inlets each for communicating cooling air from the central cooling channel to a plurality of radially extending sub-channels each sub-channel sharing an intermediate wall extending along a direction having a major component along the radial axis of the airfoil, said plurality of radially extending cooling channels being axially spaced.

9. The gas turbine engine as set forth in claim 8, wherein said plurality of radially extending sub-channels providing a microcircuit having a relatively thin thickness in a direction defined between said central cooling channel and one of said concave and convex walls of the airfoil.

10. The gas turbine engine as set forth in claim 9, wherein there are a plurality of microcircuit cooling channels in said airfoil.

11. The gas turbine engine as set forth in claim 9, wherein air passes into said plurality of inlets, and toward said one wall, said plurality of inlets communicating with a first 90° bend into a plurality of communication channels, said first 90° bend extending into a direction generally parallel with said one of said outer wall, and into a second 90° bend, said second 90° bend turning said plurality of communication channels into said plurality of radially extending sub-channels, and radially through the airfoil.

12. The gas turbine engine as set forth in claim 8, wherein said at least one of the rotor blades and vanes is a rotor blade.

13. The gas turbine engine component of claim 8 wherein said subchannels and said inlets are extremely thin and small relative to said blade.

14. A core for forming a cast article comprising:

a first portion for forming a central cooling channel in a cast article;

a plurality of second portions contacting said first solid portion, said second portions being spaced from each other with intermediate voids each intermediate void defining an intermediate wall along a length of said first portion, each of said second portions communicating with a plurality of third portions, with voids formed between adjacent ones of said third portions each void defining an intermediate wall, and said third portions extending along a direction having a major component that is perpendicular to a direction in which said second portions extend away from said first portion.

15. The core as set forth in claim 14, wherein said plurality of second portions each extend into a plurality of fourth portions which bends approximately 90° relative to said second portions, and said fourth portions then extending in another 90° bend into said third portions.

16. The core as set forth in claim 14, wherein said core for forming a gas turbine component having an airfoil.

17. The core as set forth in claim 14, wherein the component is a turbine blade.

18. The core of claim 14 wherein said void and said intermediate voids are extremely thin and small relative to said cast article.

* * * * *